United States Patent [19]

Koike et al.

[11] Patent Number: 4,579,072

[45] Date of Patent: Apr. 1, 1986

[54] ZIG ZAG SEWING MACHINE NEEDLE

[75] Inventors: Mikio Koike; Akiyoshi Sasano, both of Tokyo, Japan

[73] Assignee: Janome Sewing Machine Industry Co., Ltd., Japan

[21] Appl. No.: 630,913

[22] Filed: Jul. 13, 1984

[30] Foreign Application Priority Data

Jul. 14, 1983 [JP] Japan ..... 58-108258[U]

[51] Int. Cl.[4] ..... D05B 85/00; D05B 3/00

[52] U.S. Cl. ..... 112/222; 112/184; 112/443

[58] Field of Search ..... 112/184, 222, 182, 228, 112/158 R

[56] References Cited

U.S. PATENT DOCUMENTS

| | | | |
|---|---|---|---|
| 1,949,349 | 2/1934 | Brown | 112/222 |
| 3,386,399 | 6/1968 | Seck | 112/158 R X |
| 3,986,468 | 10/1976 | Szostak et al. | 112/222 |
| 4,122,788 | 10/1978 | Hickson | 112/222 |
| 4,458,614 | 7/1984 | Iwashita | 112/182 X |

*Primary Examiner*—Werner H. Schroeder
*Assistant Examiner*—Andrew M. Falik
*Attorney, Agent, or Firm*—William A. Drucker

[57] ABSTRACT

A sewing machine needle is capable of vertically reciprocating between upper and lower dead points and swinging laterally within a predetermined amplitude between two extreme lateral positions to form zigzag stitches on a fabric material in cooperation with a hook of a rotary loop taker. The needle comprises a relatively thick upper base portion by which the needle is attached to a needle bar of the sewing machine and a shank formed integrally with the upper base portion and adapted to reciprocatingly pass through the fabric material. The shank is composed of a relatively thin shaft, the upper end of which is integrally connected to the upper portion, and a lower portion having a pointed end at the lower end thereof and a needle eye formed near the pointed end, between which there is located a tapered step portion designed to be positioned above the fabric material when the thread loop, formed when the needle is in one of the extreme lateral positions, is caught by the hook and, in turn, positioned below the fabric material when the thread loop formed when the needle is in the other extreme lateral position is caught by the hook.

2 Claims, 12 Drawing Figures

ZIG ZAG SEWING MACHINE NEEDLE

BACKGROUND OF THE INVENTION

This invention relates to a sewing machine needle and, more particularly, to a needle used for a zigzag sewing machine.

As generally known, a sewing machine needle accompanied by an upper thread is adapted to vertically be reciprocated between an upper dead point and a lower dead point in synchronism with rotation of a horizontal loop taker, so that a thread loop of the upper thread formed beneath a fabric is caught by a hook of the loop taker while the needle ascends from the lower dead point, which thread loop is thereby interlocked with a lower thread to form a stitch. In zigzag stitching operation, the needle is also caused to laterally swing in a predetermined amplitude and, accordingly, while the needle swings laterally there will be a change in the relative position between the needle and the hook of the rotary loop taker in which position the latter is about to catch the thread loop formed about the former. More particularly, as shown in FIG. 1, in a case of the loop taker being rotated in the counterclockwise direction, the thread loop (L) of the needle at the rightmost position is caught by the hook 1 of the loop taker when the needle 2 ascends from the lower dead point by an amount $\delta_2$, whereas a larger thread loop (L) of the needle 2 at the leftmost position is caught by the hook 1 when the needle 2 goes up from the lower dead point by an amount $\delta_1$, which is larger than $\delta_2$. The needle 2 at the leftmost position is therefore subjected to a greater degree of friction with the fabric while it goes up an amount $\delta_1$, and accordingly the thread loop (L) formed in the leftmost position of the needle 2 will be larger than that in the rightmost position as shown. This may, however, often result in sewing troubles, that is, failure of the hook 1 to catch the thread loop (L). For example, when fabrics 3 of elastic or stretchable nature are being sewn together, the friction between the flexible fabrics 3 and the needle 2 will cause the fabrics 3 to be pulled into a needle hole 4*a* of a needle plate 4 as the needle 2 descends, while the fabrics 3 are brought up from the needle plate 4 as the needle 2 ascends, as shown in FIGS. 2 and 3 respectively. Such phenomena will prevent the needle thread from being formed into a sufficient loop, especially when the needle 2 is positioned in the rightmost position in the zigzag stitching operation. Whereas, in the leftmost position of the needle 2, when stitching ordinary fabrics 5, a big thread loop (L) will be formed, but the loop (L) has a tendency of inclining to one side and often twisting around the needle 2 as shown in FIG. 4, especially if the thread is made of cotton. Such a thread loop (L) is of course difficult to be caught by the hook 1. Due to the above described sewing problems in which the hook 1 fails to catch the thread loop formed during the zigzag stitching operation, the resulting stitches would include many skipped stitches. However, there has not been found a way to solve this problem.

SUMMARY OF THE INVENTION

It is therefore an object of the invention to provide a novel sewing machine needle for a zigzag sewing machine which is certain to form a thread loop beneath a fabric capable of being caught by a rotary loop taker in any lateral position of the needle and in any stitching condition.

BRIEF DESCRIPTION OF THE DRAWINGS

The foregoing and further objects and advantages of the invention can be fully understood from the following detailed description when read in conjunction with the accompanying drawings in which.

PREFERRED EMBODIMENT OF THE INVENTION

A preferred embodiment of the invention will now be described while referring to FIGS. 5 through 12 in which identical parts or materials already shown in FIGS. 1–4 are accompanied by the identical numerals.

Figure 5:
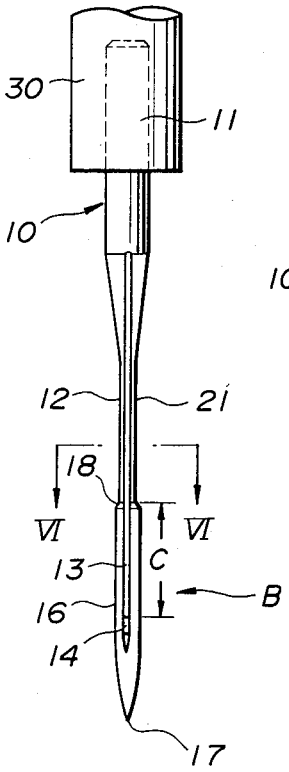
FIG. 5 is a front view showing a sewing machine needle embodying the invention.
Figure 6:
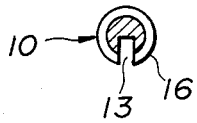
FIG. 6 is a laterally sectioned view taken along the line 6—6 in FIG. 5.
Figure 7:
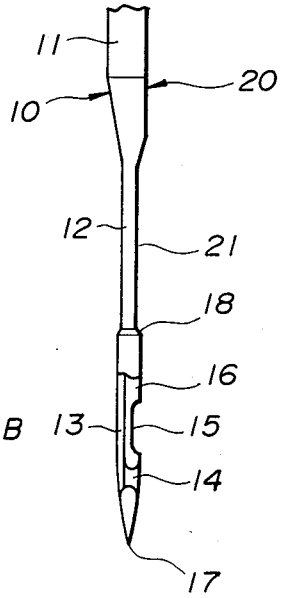
FIG. 7 is a longitudinally and partly sectioned view taken in the direction of the arrow B in FIG. 5.
Figure 4:
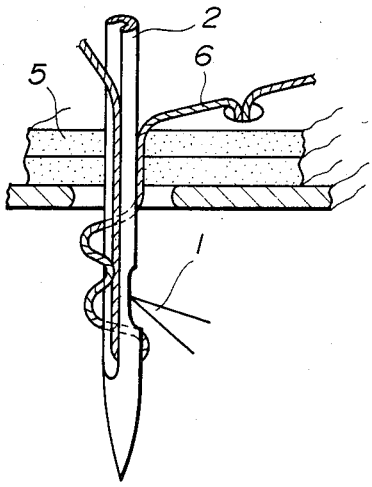
FIG. 4 Prior Art

A sewing machine needle 10 of this invention has a specific contour illustrated in FIGS. 5–7. More particularly, the axially elongated needle 10 comprises an upper base portion 11 by which the needle is attached to a needle bar 30 and which is substantially cylindrical with a maximum diameter but has an axially extended flat face 20 on one side thereof, and a shank 12 having the upper end connected to the lower end of the upper base portion 11 by a tapered portion as shown. The shank 12 is composed of a lower portion 16 of the needle 10 with a medium diameter having a needle eye 14 formed in the neighborhood of a pointed end 17, and a shaft portion 21 of a minimum diameter located between the lower portion 16 and the upper base portion 11. A tapered step portion 18 is formed between the lower end of the shaft portion 21 and the upper end of the lower portion 16. The needle 10 has a thread guide groove 13 formed in the axial direction and extending from the lower end of the upper base portion 11 to the needle eye 14 of the lower portion 16 on the side of the needle opposite to the side on which the axially extended flat face 20 is formed. The lower portion 16 has a concave portion 15 extended axially thereof as shown just above the needle eye 14 on the side opposite to the thread guide groove 13.

According to the invention, the tapered step portion 18 is provided at a position to satisfy the following conditions: Namely, in case a zigzag stitching operation is performed with the maximum lateral swinging movement of the needle 10, at one of the needle positions where the needle 10 goes up a larger amount from the lower dead point thereof until the hook 1 of the rotary loop taker comes to the needle, that is, at the leftmost needle position according to this embodiment, the tapered step portion 18 is located a little above the needle plate 4 as shown in FIG. 8 when the hook is about to catch the thread loop of the needle at this position; and whereas at the other extreme position of the maximum lateral swinging amplitude where the needle goes up a smaller amount from the lower dead point until the hook 1 comes to the needle, that is at the rightmost needle position in this embodiment, the tapered step portion 18 is located a little below the upper face of the needle plate 4 as shown in FIG. 9 when the hook 1 is about to catch the thread loop of the needle at this position.

Figure 1:
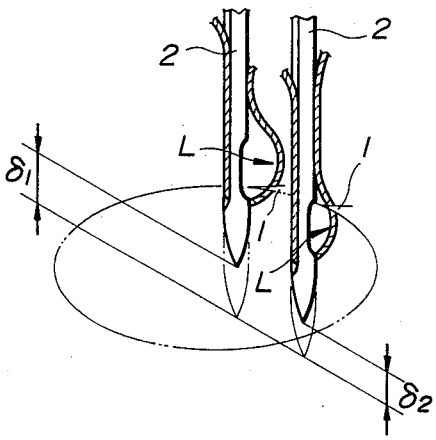
FIG. 1 Prior Art
FIGS. 1 through 4 are explanatory views detailing the causes of skipped stitches in the stitching operation when a prior art sewing machine needle is used.
Figure 2:
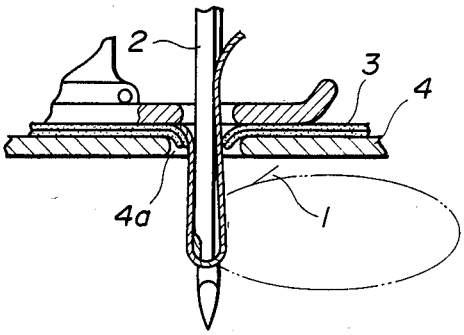
FIG. 2 Prior Art
Figure 3:
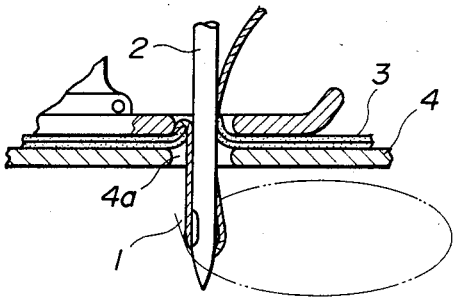
FIG. 3 Prior Art
Figure 8:
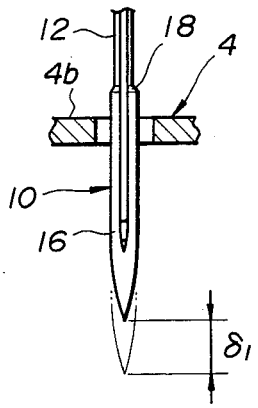
FIGS. 8 and 9 show positional relations between a needle plate and the needle of the invention in which a hook of a rotary loop taker is going to catch a thread loop of the needle.
Figure 9:
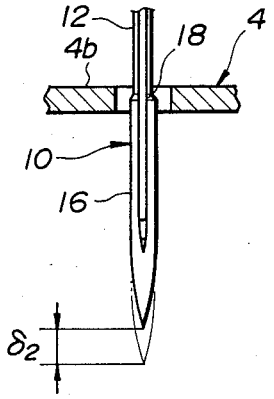

In this embodiment, the amounts $\delta_1$ and $\delta_2$ in FIG. 1 may be applied to FIGS. 8 and 9 respectively. Precisely, the amount $\delta_1$ is approximately 3.5 mm and the amount $\delta_2$ is approximately 1.5 mm. The distance is approximately 8.5 mm between the upper face of the needle plate 4 and the upper end of the needle eye 14 of the needle 10 when the needle is at the lower dead point thereof. Provided that the distance between the tapered step portion 18 and the upper end of the needle eye 14 is defined by C, then the distance C is designed in this embodiment to satisfy the relationship: $5\ mm < C < 7\ mm$.

Figure 10:
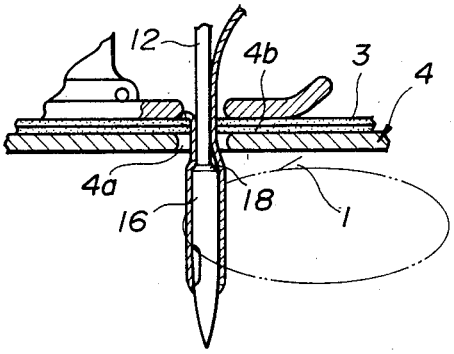
FIGS. 10 and 11 are explanatory views showing a process in which a loop is formed when stitching elastic or stretcheable fabrics by means of the needle of the invention, which loop being caught by the hook of the rotary loop taker.
Figure 11:
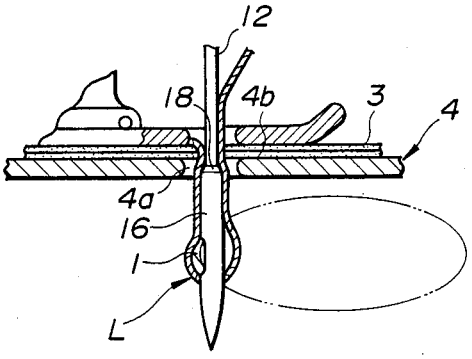

According to the invention, the zigzag stitching operation may be effected without failure of the hook 1 to catch a thread loop (L). More particularly, FIGS. 10 and 11 show a manner in which the fabrics 3 of elastic or stretchable nature are sewn up by means of the sewing machine needle 10 of this invention in the rightmost position in the lateral amplitude. In this case, although the elastic fabrics 3 will be pulled into the needle hole 4*a* of the needle plate 4 due to friction between the fabrics 3 and the lower portion 16 of the needle 10 while the needle 10 descends, the pulled down portion of the fabrics 3 will return to its normal position above the needle plate 4 after the lower portion 16 of the needle 10 goes past the fabrics 3 due to little friction between the fabrics 3 and the shaft portion 21 of the minimum diameter. Consequently, the fabrics 3 become flat on the needle plate 4 when the needle 10 comes to the lower dead point, as shown in FIG. 10. In the ascending course of the needle 10 from the lower dead point, the thread loop (L) is formed and then caught by the hook 1, before the tapered step portion 18 of the needle 10 comes to the underside of the fabrics 3 as shown in FIG. 11. Therefore the fabrics 3 are prevented from raising up from the needle plate 4, before the loop (L) is caught by the hook 1. Thus, the thread loop (L) formed at this time will be large enough to be caught by the hook 1.

Figure 12:
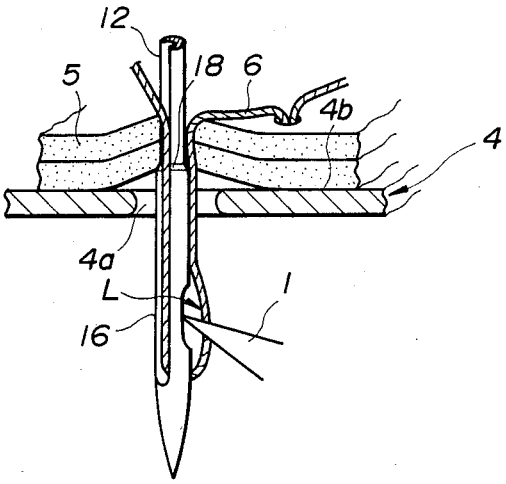
FIG. 12 is an explanatory view showing a process in which a loop is formed when stitching ordinary fabrics by means of the needle of the invention carrying a cotton thread, which loop being caught by the hook of the rotary loop taker.

FIG. 12 shows a manner in which the ordinary fabrics 5 are sewn with a cotton thread 6 with the needle 10 being located in the leftmost position. As described above, the needle 10 of this invention is so designed that the tapered step portion 18 is positioned under the fabrics 5 when the needle 10 is in the lower dead point. But the portion 18 comes to the underside of the fabrics 5 as the needle 10 ascends, and raises the fabrics 5 from the needle plate 4 as shown when the thread loop (L) is caught by the hook 1. Thus, the tapered step portion 18 will function to raise the fabrics 5 to thereby prevent the thread loop (L) from being excessively enlarged. This will prevent the thread loop (L) from twisting around the needle 10 assuring the loop (L) to be caught by the hook 1.

We claim:

1. A sewing machine needle in combination with a zigzag sewing machine, wherein said needle is vertically reciprocated to penetrate a fabric placed on an upper face of a needle plate, and is swingable laterally of a fabric feeding direction between two extreme predetermined needle positions to form zigzag stitches on the fabric material in cooperation with a hook of a rotary loop taker rotated in a timed relation with said needle to catch a thread loop formed beside said needle under a needle plate of the sewing machine as said needle goes up from a lower dead point, said needle comprising an upper base portion axially elongated with a maximum thickness by which said needle is attached to a needle bar of the sewing machine, and a shank formed integral with said upper base portion and axially elongated to reciprocatingly pass through and out of the fabric material, said shank being composed of a lower portion axially elongated with a medium thickness and terminated into a pointed end with a needle eye formed in the neighborhood of said pointed end, said lower portion having an axially extended concave portion formed immediately above said needle eye for enabling said hook to intersect said needle at said concave portion to catch the thread loop, a shaft portion of a minimum thickness located between said upper base portion and said lower portion, and a tapered step portion formed at a juncture between said shaft portion and said lower portion, and being located above said concave portion with a substantial distance provided therebetween, wherein said substantial distance is such that in one of said predetermined needle positions the tapered step portion is located below the upper face of the needle plate when said hook is about to catch said needle thread loop and in the other of said predetermined needle positions said tapered step portion is located above said upper face when said needle is about to catch said thread loop, said tapered step portion also engaging the underside of said fabric material during the needle ascension from a lower dead point position to said loop catching position to raise up the same from the upper face of said needle plate whereby assuring that said thread loop is caught by said hook.

2. The sewing machine needle according to claim 1 wherein said shank is formed with a thread guide groove extended axially thereof and terminating into said needle eye.

* * * * *